US008757262B2

(12) United States Patent
Dotson

(10) Patent No.: US 8,757,262 B2
(45) Date of Patent: Jun. 24, 2014

(54) APPARATUS AND METHOD FOR ABRASIVE JET PERFORATING AND CUTTING OF TUBULAR MEMBERS

(75) Inventor: Thomas L. Dotson, Woodburn, KY (US)

(73) Assignee: TD Tools, Inc., Woodburn, KY (US)

( * ) Notice: Subject to any disclaimer, the term of this patent is extended or adjusted under 35 U.S.C. 154(b) by 0 days.

(21) Appl. No.: 12/653,803

(22) Filed: Dec. 18, 2009

(65) Prior Publication Data

US 2011/0146989 A1 Jun. 23, 2011

(51) Int. Cl.
*E21B 43/114* (2006.01)

(52) U.S. Cl.
CPC ..... *E21B 43/114* (2013.01)
USPC ..... 166/298; 166/55.2; 166/55.7; 166/255.2

(58) Field of Classification Search
USPC ..... 166/298, 55.2, 55.6, 55.7, 55.8, 255.2; 175/4.52
See application file for complete search history.

(56) References Cited

U.S. PATENT DOCUMENTS

| | | | | |
|---|---|---|---|---|
| 3,130,786 | A * | 4/1964 | Brown et al. | 175/424 |
| 3,145,776 | A | 8/1964 | Pittman | |
| 3,266,571 | A | 8/1966 | St. John et al. | |
| 4,781,250 | A | 11/1988 | McCormick et al. | |
| 5,499,678 | A | 3/1996 | Surjaatmadja et al. | |
| 5,765,756 | A | 6/1998 | Jordan et al. | |
| 6,564,868 | B1 | 5/2003 | Ferguson et al. | |
| 7,441,595 | B2 * | 10/2008 | Jelsma | 166/117.7 |
| 7,497,259 | B2 | 3/2009 | Leising et al. | |
| 2007/0125577 | A1 * | 6/2007 | Brunet | 175/62 |
| 2007/0175637 | A1 * | 8/2007 | Leising et al. | 166/297 |
| 2008/0179060 | A1 * | 7/2008 | Surjaatmadja et al. | 166/298 |

OTHER PUBLICATIONS

S.W. Loving et al., "Abrasive cutting technology deployed via coiled tubing", SPE 92866, SPE/ICoTA Coiled Tubing Conf. and Exhib., Apr. 2005.

G.R. Hebert, et al., "Cutting concentric casing strings with sand slurry",SPE 113734, SPE/ICoTA Coiled Tubing and Well Intervention Conf. and Exhib., Apr. 2008.

* cited by examiner

*Primary Examiner* — Giovanna Wright
*Assistant Examiner* — Richard Alker
(74) *Attorney, Agent, or Firm* — Fulbright & Jaworski LLP

(57) ABSTRACT

An apparatus for abrasive jet cutting comprises an abrasive jet perforating tool coupled rotatably to a tubing string and a horizontal indexing tool coupled connectably to the perforating tool. A tubing swivel, an extension tool with protective sleeve, and an anchor may also be used. A method for abrasive jet cutting comprises determining well parameters for a well; assembling, according to the well parameters, the apparatus for abrasive jet perforating; and using the perforating tool to perforate tubular members in the well. A horizontal indexing tool is used to rotate the perforating tool and the perforating tool is used to cut tubular members in the well. An extension tool with a protective sleeve is used to protect the apparatus. A tubing swivel may be used to allow the perforating tool to rotate freely and an anchor may be used to prevent the perforating tool from moving vertically.

22 Claims, 6 Drawing Sheets

APPARATUS AND METHOD FOR ABRASIVE JET PERFORATING AND CUTTING OF TUBULAR MEMBERS

CROSS-REFERENCES TO RELATED APPLICATIONS

Not Applicable

FEDERALLY SPONSORED RESEARCH OR DEVELOPMENT

Not Applicable

SEQUENCE LISTING, TABLE, OR COMPUTER LISTING

Not Applicable

BACKGROUND OF THE INVENTION

1. Field of the Invention

This invention relates generally to the field of treating wells to stimulate fluid production. More particularly, the invention relates to the field of abrasive jet cutting of tubular members in oil and gas wells.

2. Description of the Related Art

Abrasive jet perforating uses fluid slurry pumped under high pressure to perforate tubular goods around a wellbore, where the tubular goods include tubing, casing, and cement. Since sand is the most common abrasive used, this technique is also known as sand jet perforating (SJP). Abrasive jet perforating was originally used to extend a cavity into the surrounding reservoir to stimulate fluid production. It was soon discovered, however, that abrasive jet perforating could not only perforate, but cut (completely sever) the tubular goods into two pieces. Sand laden fluids were first used to cut well casing in 1939. Abrasive jet perforating was eventually attempted on a commercial scale in the 1960s. While abrasive jet perforating was a technical success (over 5,000 wells were treated), it was not an economic success. The tool life in abrasive jet perforating was measured in only minutes and fluid pressures high enough to cut casing were difficult to maintain with pumps available at the time. A competing technology, explosive shape charge perforators, emerged at this time and offered less expensive perforating options.

Consequently, very little work was performed with abrasive jet perforating technology until the late 1990's. Then, more abrasive-resistant materials used in the construction of the perforating tools and jet orifices provided longer tool life, measured in hours or days instead of minutes. Also, advancements in pump materials and technology enabled pumps to handle the abrasive fluids under high pressures for longer periods of time. The combination of these advances made the abrasive jet perforating process more cost effective. Additionally, the recent use of coiled tubing to convey the abrasive jet perforating tool down a wellbore has led to reduced run time at greater depth. Further, abrasive jet perforating did not require explosives and thus avoids the accompanying danger involved in the storage, transport, and use of explosives. However, the basic design of abrasive jet perforating tools used today has not changed significantly from those used in the 1960's.

Abrasive jet perforating tools and casing cutters were initially designed and built in the 1960's. There were many variables involved in the design of these tools. Some tool designs varied the number of jet locations on the tool body, from as few as two jets to as many as 12 jets. The tool designs also varied the placement of those jets, such, for example, positioning two opposing jets spaced 180° apart on the same horizontal plane, three jets spaced 120° apart on the same horizontal plane, or three jets offset vertically by 30°. Other tool designs manipulated the jet by orienting it at an angle other than perpendicular to the casing or by allowing the jet to move toward the casing when fluid pressure was applied to the tool.

The need to sever tubular goods is common in the oil and gas industry. Mechanical cutters and explosive cutters, employed for many years, are still widely used and being improved upon. Mechanical cutters typically employ blades that pivot out from the tool body while the cutting tool is turned by means of a downhole motor. The blades cut through the casing to sever the pipe. Explosive cutters generally employ a shaped charge to tear the pipe into two pieces. Newer chemical cutters employ corrosive chemicals to dissolve the pipe to sever it. More recently, high pressure abrasive fluid cutters have been employed in conjunction with specialized downhole motors to rotate an abrasive fluid stream against the tubing to sever it.

All of these conventional cutting tools have problems associated with their use. Mechanical cutters have size and strength limitations. Explosive cutters introduce the difficulties of purchasing, transporting, and using explosives, particularly in the United States, but also in the rest of the world. Chemical cutters have temperature and pressure limitations. Current abrasive jet cutters typically employ specially-designed downhole motors (to rotate the abrasive fluid jets), which are expensive. Additionally, tight access size restrictions, non-circular or irregular surfaces to be cut, and horizontal and vertical operation pose problems for all the current cutter types.

The following patents and publications are representative of conventional abrasive jet perforating and cutting tools, along with apparatuses and methods that may be employed with the tools.

U.S. Pat. No. 3,145,776 by Pittman, "Hydra-Jet Tool", discloses protective plates for an abrasive jet perforating tool. The plates, made of abrasive resistant material, are designed to fit flatly to the body of the tool around the perforating jets. The plates are employed to protect the body of the tool from ejected abrasive material that rebounds. The protective plates disclosed in Pittman are not designed to protect the abrasive jets themselves.

U.S. Pat. No. 4,781,250, by McCormick et al., "Pressure Activated Cleaning Tool", discloses a downhole tool for cleaning tubing, casing and flow lines with pressurized cleaning fluid pumped through coiled tubing. The cleaning tool is rotated by a J-slot indexing tool activated by fluid pressure changes. The McCormick et al. patent does not disclose employing the indexing tool with perforating or cutting tools.

U.S. Pat. No. 3,266,571 by St. John et al., "Casing Slotting" discloses an abrasive jet perforating tool designed to cut slots of controlled length. The slot lengths are controlled by abrasive resistant shields attached to the tool to block the flow from rotating abrasive jets. The St. John et al. patent does not disclose severing tubular members.

U.S. Pat. No. 5,499,678 by Surjaatmadja et al., "Coplanar Angular Jetting Head for Well Perforating", discloses a jetting head for use in an abrasive jet perforating tool. The jet openings in the jetting head are coplanar and positioned at an angle to the longitudinal axis of the tool. The angle is chosen so that the plane of the jet openings is perpendicular to the axis of least principal stress in the formation being fractured.

The tool must be custom-made for each job, since the entire jet head is angled into the tool.

U.S. Pat. No. 5,765,756 by Jorden et al., "Abrasive Slurry Jetting Tool and Method", discloses an abrasive jet perforating tool with telescoping jetting nozzles. The jetting nozzles are operated perpendicularly to the longitudinal axis of the tool body, although the nozzle assemblies can pivot back into the tool body for retrieval back up the wellbore. The Jordan et al. patent discloses using the perforating tool for removing a casing section, cutting a window, series of longitudinal slots, or plurality of perforations in a wellbore casing, and removing or cleaning a wellbore formation to enhance perforation. The Jordan et al. patent does not disclose severing tubular members.

U.S. Pat. No. 6,564,868 B1, by Ferguson et al., "Cutting Tool and Method for Cutting Tubular Member", discloses an abrasive jet perforating tool for severing tubular members, such as production tubing. The jetting nozzles are preferably perpendicular to the longitudinal axis of the tool body. The Ferguson et al. patent discloses rotating the cutting tool by means of a downhole motor, such as disclosed in U.S. Pat. No. 6,439,866 B1, by Farkas et al., "Downhole Rotary Motor with Sealed Thrust Bearing Assembly".

U.S. Pat. No. 7,497,259 B2, by Leising et al., "System and Method for Forming Cavities in a Well", discloses a downhole assembly string for perforating wells. The string comprises an anchoring mechanism, a multi-cycle vertical incrementing tool, a swivel orienting device and a perforation tool, suspended from coiled tubing. The perforation tool is moved vertically by the incrementing tool, which is activated by fluid pressure changes. The Leising et al. patent does not disclose employing the incrementing tool to rotate the perforation tool.

SPE publication by Loving et al., "Abrasive Cutting Technology Deployed Via Coiled Tubing", SPE 92866, SPE/ICoTA Coiled Tubing Conference and Exhibition, April 2005, discloses an abrasive jet cutting tool for cutting production tubing, drill pipe, drill collars, completion components, and casing strings. The cutting tool is deployed using conventional coiled tubing and is rotated by pumping an abrasive slurry through a downhole sealed bearing, positive displacement motor mounted above an abrasive cutting head. The abrasive slurry is pumped down the coiled tubing by a conventional high pressure pump.

SPE publication by Hebert et al., "Cutting Concentric Casing Strings with Sand Slurry", SPE 113734, SPE/ICoTA Coiled Tubing and Well Intervention Conference and Exhibition, April 2008, discloses a case history of cutting a 7-in. liner inside a 9⅝-in. casing with an abrasive jet cutting tool. The jet cutting tool was deployed using drill pipe and a downhole slow-rotating hydroblast motor.

Thus, a need exists for an abrasive jet perforating tool and method of use, in particular for severing tubular members, that can pass through tight restrictions and can be used in small inner diameter pipe. Preferably, the perforating tool does not require an expensive downhole motor or means for rotating the deployment tubing from the surface.

BRIEF SUMMARY OF THE INVENTION

The invention is an apparatus and a method for providing abrasive jet perforating and cutting of tubular goods in wells. In one embodiment, the invention is an apparatus for performing abrasive jet cutting comprising an abrasive jet perforating tool coupled rotatably to a tubing string and a horizontal indexing tool coupled connectably to the perforating tool. In other embodiments, a tubing swivel, an extension tool with protective sleeve, and an anchor may also be used.

In another embodiment, the invention is a method for performing abrasive jet cutting comprising determining well parameters for a well; assembling, according to the well parameters, the apparatus for abrasive jet perforating; and using the perforating tool to perforate tubular members in the well. In another embodiment, a horizontal indexing tool is used to rotate the perforating tool and the perforating tool is used to cut tubular members in the well. In another embodiment, an extension tool with a protective sleeve is used to protect the apparatus. In another embodiment, a tubing swivel may be used to allow the perforating tool to rotate freely and an anchor may be used to prevent the perforating tool from moving vertically.

BRIEF DESCRIPTION OF THE DRAWINGS

The invention and its advantages may be more easily understood by reference to the following detailed description and the attached drawings, in which.

While the invention will be described in connection with its preferred embodiments, it will be understood that the invention is not limited to these. On the contrary, the invention is intended to cover all alternatives, modifications, and equivalents that may be included within the scope of the invention, as defined by the appended claims.

DETAILED DESCRIPTION OF THE INVENTION

The invention is an apparatus and a method for providing improved abrasive jet perforation and cutting of tubular members in wells, particularly oil and gas wells. The invention allows operation of the tool in small diameter tubing while decreasing wear damage and extending the life of the tool. Advantages include the ability to cut tubing without using a downhole motor or requiring the rotation of the well string from the surface. In several embodiments, the invention is an apparatus for performing abrasive jet cutting. These embodiments of the invention are described below with reference to FIGS. 2-8. In other embodiments, the invention is a method for performing abrasive jet cutting. These embodiments of the invention are described below with reference to FIG. 9. In other embodiments, the invention is an apparatus and method for performing abrasive jet perforating.

Figure 1:
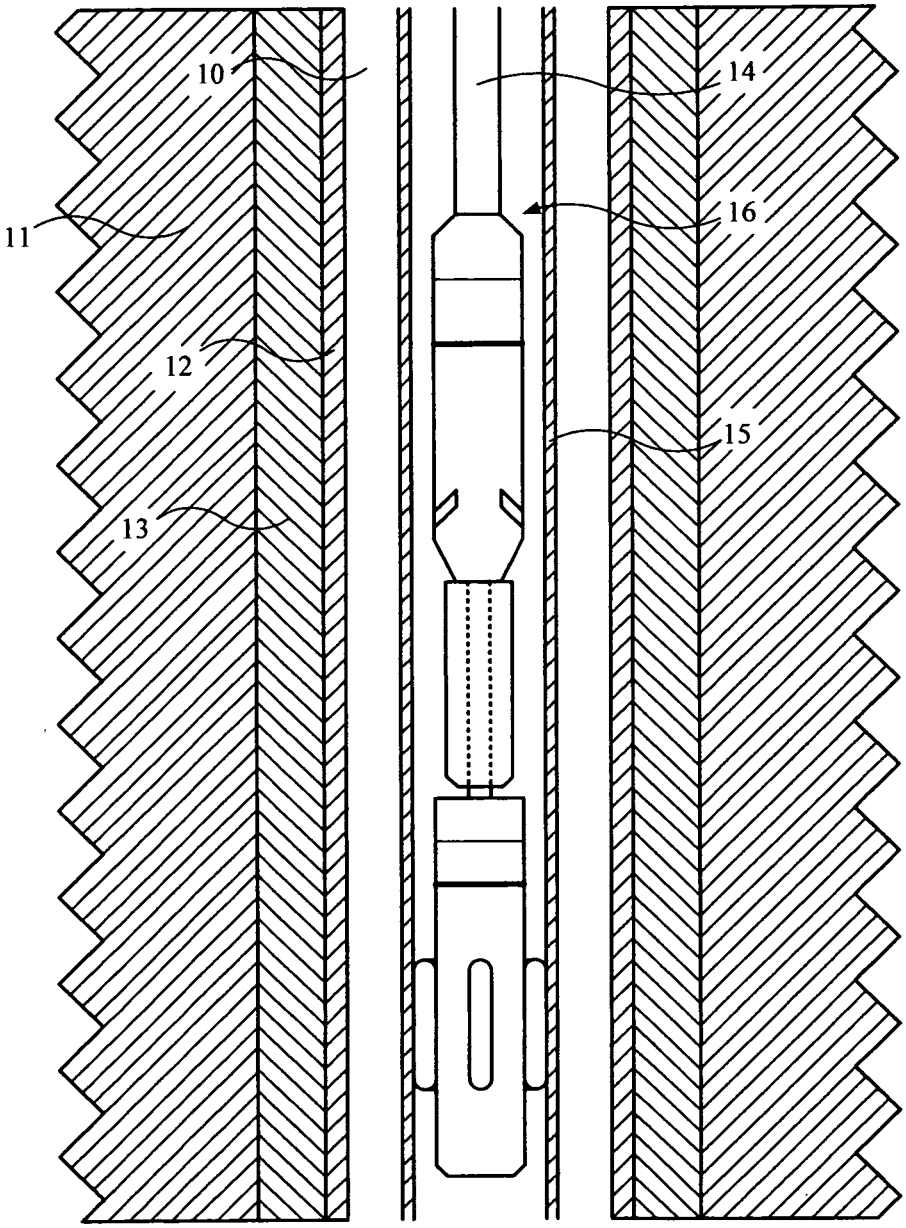
FIG. 1 shows a schematic side view of a cutting assembly in a wellbore.

FIG. 1 shows a schematic side view (not necessarily to scale) of a cutting assembly in a wellbore. FIG. 1 shows a bottomhole assembly for cutting tubular members in a wellbore using an abrasive jet perforating tool, such as may be used in the present invention. A wellbore 10 is shown penetrating a reservoir 11. The wellbore 10 is surrounded by a casing 12 (or liner), which in turn is surrounded by cement 13, fixing the casing 12 to the reservoir 11. Tubing 14 extends vertically downward into the wellbore 10. The tubing 14 comprises jointed pipe, coiled tubing, or any other type of tubing used in a well. Suspended from the tubing 14 into a tubular member 15 is a cutting assembly 16. The cutting assembly 16 comprises an abrasive jet perforating tool and a horizontal indexing tool, along with other possible bottomhole tools, all described below in the discussion with reference to FIGS. 2-8.

Figure 2:
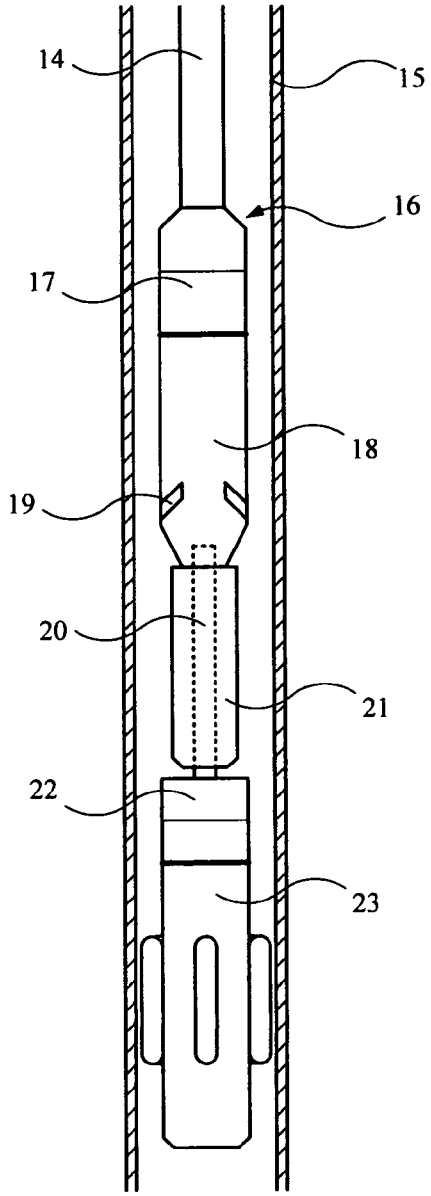
FIG. 2 shows a schematic side view of one embodiment of a cutting assembly of the invention.

FIG. 2 shows a schematic side view (not necessarily to scale) of one embodiment of the cutting assembly of the invention. In this embodiment, the cutting assembly 16, inside a tubular member 15, comprises a number of downhole tools suspended from tubing 14. These downhole hole tools include a tubing swivel 17 coupled to the tubing 14. In the embodiment illustrated in FIG. 2, the tubing string 14 is shown mounted below and connected to the tubing 14. In other embodiments, the tubing swivel 17 may be positioned in a different location in the bottomhole assembly or not present. The tubing swivel 17 is used to allow the downhole tools of the cutting assembly 16 that are mounted below the tubing swivel 17 to rotate freely without binding the tubing 14 during the cutting of the tubular member 15.

An abrasive jet perforating tool 18 of the invention is coupled rotatably to the tubing 14. In the embodiment illustrated in FIG. 2, the abrasive jet perforating tool 18 is shown coupled to the tubing 14 through the tubing swivel 17. In particular, the abrasive jet perforating tool 18 is shown mounted below and connected to the tubing swivel 17. In other embodiments, the abrasive jet perforating tool 18 may be positioned in a different location in the bottomhole assembly, although it will always be present. The abrasive jet perforating tool 18 is used to cut the tubular member 15 in the wellbore. In other embodiments, the abrasive jet perforating tool 18 is used to perforate the tubular member 15 in the wellbore. The abrasive jet perforating tool 18 ejects abrasive-carrying fluid slurry under high pressure to perforate the tubular member 15.

The abrasive perforating tool 18 is a form of an abrasive perforating tool. The purpose of an abrasive jet perforating tool is to provide a cavity in the reservoir 11 that communicates through the cement 13 and casing 12 with the wellbore 10. This cavity provides improved fluid flow from the reservoir 11 to the wellbore 10, preferably from a producing zone in the reservoir 11. In an alternative situation called an open-hole wellbore, there is no casing 12 or cement 13, so the wellbore 10 directly contacts the reservoir 11. This use of the tool 18 as a perforating tool is described in co-pending U.S. patent application Ser. No. 12/380,062, "Apparatus and Method for Abrasive Jet Perforating", filed Feb. 22, 2009, with the inventor of the present application as co-inventor.

In the use of the abrasive jet perforating tool 18 as a cutting tool, as in the present invention, the purpose is to laterally cut through a tubular member 15 all the way around so that the tubular member 15 is severed and can be remove from the wellbore. The abrasive jet perforating tool 18 further comprises threaded abrasive jets 19 mounted in a direction that is away from perpendicular. In the particular embodiment illustrated here in FIG. 2, the abrasive jet perforating tool 18 further comprises threaded abrasive jets 19 mounted in a direction that is below perpendicular. In another embodiment, the abrasive jet perforating tool 18 further comprises threaded abrasive jets 19 mounted in a direction that is above perpendicular. This orientation of the threaded abrasive jets 19 is illustrated below in FIG. 3.

An extension tool 20 is coupled to the abrasive jet perforating tool 18. In the embodiment illustrated in FIG. 2, the extension tool 20 is shown mounted below and connected to the abrasive jet perforating tool 18. A protective sleeve 21 is mounted on and longitudinally encircles the extension tool 20. In other embodiments, the extension tool 20 and accompanying protective sleeve 21 may be positioned in a different location in the bottomhole assembly or not present. For example, the extension tool 20 and accompanying protective sleeve 21 may be mounted above and connected to the abrasive jet perforating tool 18. The protective sleeve 21 on the extension tool 20 is used to protect the perforating assembly 16 (in particular, the abrasive jet perforating tool 18) from damage due to backsplash (rebound) of abrasive material in the fluid slurry ejected by the threaded abrasive jets 19 mounted pointing below perpendicular in the abrasive jet perforating tool 18. The extension tool 20 positions any lower downhole tools in the cutting assembly 16 below the damaging backsplash. The protective sleeve 21 is composed of a material that is highly resistant to abrasion. Such materials include, but are not restricted to, tungsten carbide, boron carbide, alumina, cubic zirconium, (or other appropriate ceramics) and steel alloy with a protective coating. Since no fluids have to be pumped through the extension tool 20, the extension tool 20 can be made thinner and the protective sleeve 21 can be made thicker. This backsplash protection is discussed more fully with reference to FIG. 5 below.

A horizontal indexing tool 22 (indexer) is coupled connectably to the abrasive jet perforating tool 18. In the embodiment illustrated in FIG. 2, the horizontal indexing tool 22 is shown coupled to the abrasive jet perforating tool 18 through the extension tool 20 and accompanying protective sleeve 21. In particular, the horizontal indexing tool 22 is shown mounted below and connected to the extension tool 20. In other embodiments, the horizontal indexing tool 22 may be positioned in a different location in the bottomhole assembly, although it will always be present. The horizontal indexing tool 22 is used to rotate the abrasive jet perforating tool 18 radially in the wellbore 10. The horizontal indexing tool 22 rotates the cutting assembly 16 a predetermined angle each time the indexer is cycled by a vertical movement (stroke) of the tubing string above the indexer. The use of the horizontal indexing tool 22 has several advantages over the conventional use of a downhole motor. The horizontal indexing tool 22 has fewer moving parts than a downhole motor and thus is cheaper and easier to maintain. Additionally, the horizontal indexing tool 22 is not exposed to high pressure abrasive fluid flow, as the inner workings of a downhole motor would be, and thus, again, is cheaper and easier to maintain. In one embodiment, the horizontal indexing tool 22 is a J-slot type indexing tool.

An anchor 23 is coupled to the horizontal indexing tool 22. In the embodiment illustrated in FIG. 2, the anchor 23 is shown mounted below and connected to the horizontal indexing tool 22. In other embodiments, the anchor 23 may be positioned in a different location in the bottomhole assembly or not present. The anchor 23 is used to prevent the abrasive jet perforating tool 18 from moving vertically in the wellbore 10 during the cutting of the tubular member 15.

Figure 3:
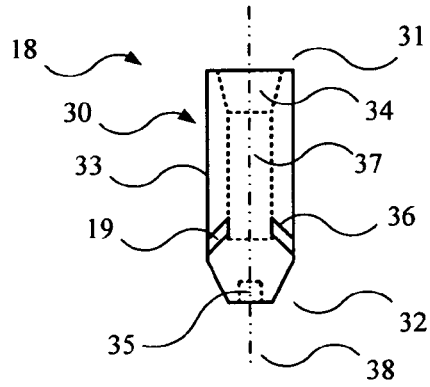
FIG. 3 shows a schematic side view of one embodiment of an abrasive jet perforating tool as used in the cutting assembly of FIG. 2.

FIG. 3 shows a schematic side view (not necessarily to scale) of one embodiment of an abrasive jet perforating tool as used in the cutting assembly of FIG. 2. Alternative embodiments of the abrasive jet perforating tool are discussed below with reference to FIGS. 4 and 8. The various embodiments of the abrasive jet perforating tool of the invention illustrated in FIGS. 2-8 is designated for consistency by reference numeral 18.

In FIG. 3, the main body of the abrasive jet perforating tool 18 comprises a conduit, preferably in the form of a generally cylindrically shaped tube 30. Although the abrasive jet perforating tool 18 is illustrated here with the preferred embodiment of a tube 30 as the body, this cylindrical shape is not necessarily a limitation of the invention. The body could have other appropriate shapes in other alternative embodiments. The abrasive jet perforating tool 18 further comprises an upper end 31, a lower end 32, and a side 33 inbetween. The abrasive jet perforating tool 18 further comprises an upper threaded connection fitting 34 on the upper end 31 and a lower threaded connection fitting 35 on the lower end 32 of the tube 30. The abrasive jet perforating tool 18 further comprises a plurality of holes 36 tapped and threaded into the side 33 of the tube 30. The abrasive jet perforating tool 18 further comprises a fluid channel 37 extending longitudinally from the upper threaded connection fitting 34 to the threaded holes 36. The fluid channel 37 does not connect to the lower threaded connection fitting 35 on the lower end 32 of the tube 30.

The upper threaded connection fitting 34 on the upper end 31 is used to connect the abrasive jet perforating tool 18 to other components of the cutting assembly (16 in FIG. 2). In particular, the upper threaded connection fitting 34 on the upper end 31 is used to connect the abrasive jet perforating tool 18 to the tubing swivel 17 in the embodiment illustrated in FIG. 2. Similarly, the lower threaded connection fitting 35 on the lower end 32 of the tube 30 is used to connect the abrasive jet perforating tool 18 to other components of the cutting assembly (16 in FIG. 2). In particular, the lower threaded connection fitting 35 on the lower end 32 of the tube 30 is used to connect the abrasive jet perforating tool 18 to the extension tool 20 in the embodiment illustrated in FIG. 2.

The threaded holes 36 are oriented in a direction that is below perpendicular to the longitudinal axis 38 of the tube 30. In another embodiment, the threaded holes 36 are oriented in a direction that is above perpendicular to the longitudinal axis 38 of the tube 30. The abrasive jet perforating tool 18 further comprises threaded abrasive jets 19 (nozzles) flush mounted in at least some of the threaded holes 36 on the side 33 of the tube 30. In a preferred embodiment, three threaded abrasive jets 19 are employed, but this number is not a restriction of the invention. The plurality of threaded holes 36 are all positioned in the same lateral plane perpendicular to the longitudinal axis 38 of the tube 30. Thus, when the abrasive jet perforating tool 18 is rotated, the combination of the threaded abrasive jets 19 mounted in the threaded holes 36 severs the tubing member. The spacing of the threaded abrasive jets 19 around the abrasive jet perforating tool 18 is designed, based on the number of threaded abrasive jets 19 used and the amount of rotation provided by each cycle of horizontal indexing tool 22, to ensure that, as the abrasive jet perforating tool 18 is rotated, the threaded abrasive jets 19 do not overlap in cutting areas. The abrasive jets 19 further comprise jetting orifices (not shown) that extend throughout the length of the abrasive jets 19.

Flush mounting the abrasive jets 19 allows for a smaller cross-section of the abrasive jet perforating tool 18, but precludes the use of protective plates to protect the abrasive jets 19 directly from backsplash of the abrasive fluid ejected by the abrasive jet perforating tool 18. The invention solves this problem by directing the backsplash of away from the abrasive jet perforating tool 18. The below perpendicular orientation of the threaded holes 36, and hence, the threaded abrasive jets 19 mounted in at least some of the threaded holes 36, acts in unison with the protective sleeve 21 on the extension tool 20 to protect the cutting assembly 16 from damage due to the backsplash. This backsplash protection is discussed more fully with reference to FIG. 5 below.

Figure 4:
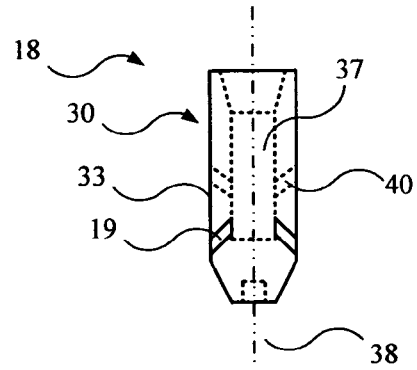
FIG. 4 shows a schematic side view of the abrasive jet perforating tool of FIG. 3 with access holes.

FIG. 4 shows a schematic side view (not necessarily to scale) of the abrasive jet perforating tool of FIG. 3 with access holes. The alternative abrasive jet perforating tool 18 uses abrasive jets 19 that are pressed directly into holes tapped, not threaded, into the side 33 of the tube 30 rather than the threaded abrasive jets 19 in threaded holes 36 illustrated in the embodiment illustrated in FIG. 3. The alternative abrasive jet perforating tool 18 employs access holes 40 extending from the side 33 of the tube 30 to the fluid channel 37. The access holes 40 are positioned above the abrasive jets 19 in the tapped holes 36 and are oriented in a direction above perpendicular to the longitudinal axis 38 of the tube 30. After the access holes 40 have been used to insert the abrasive jets 19 into the tapped holes 36, the access holes 40 are sealed. Plugs may be placed in the access holes 40 to seal the fluid channel 37 from the environment outside the abrasive jet perforating tool 18. The alternative abrasive jet perforating tool 18 further comprises the remaining features of the abrasive jet perforating tool 18 described above with reference to FIG. 3.

Figure 5:
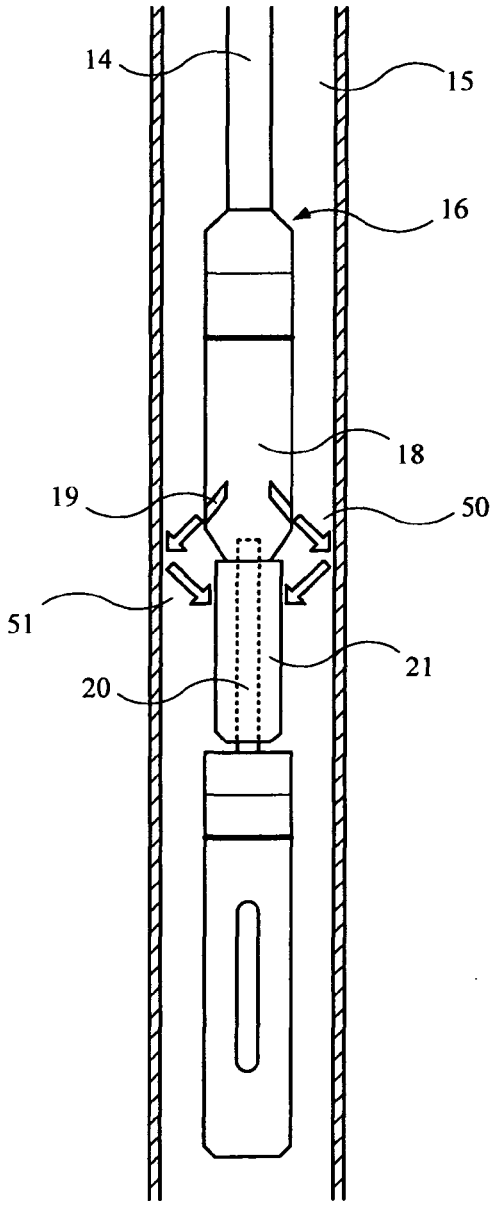
FIG. 5 shows a schematic side view of the cutting assembly of FIG. 4 in the presence of backsplash.

FIG. 5 shows a schematic side view (not necessarily to scale) of the cutting assembly of FIG. 4 in the presence of backsplash. The cutting assembly 16 is suspended from tubing 14 inside a tubular member 15. Ejected abrasive fluids 50 are ejected by the abrasive jets 19 in the abrasive jet perforating tool 18. Rebound abrasive fluid 51 rebounds from the tubular member 15 being cut. If the abrasive jets 19 were oriented in a direction perpendicular to the longitudinal axis 38 of the abrasive jet perforating tool 18, then the rebound abrasive fluid 51 would backsplash onto the abrasive jets 19 and the abrasive jet perforating tool 18, possibly damaging them. However, in this embodiment, the abrasive jets 19 are oriented in a direction below perpendicular to the longitudinal axis 38 of the abrasive jet perforating tool 18, so the ejected abrasive fluids 50 are ejected in a downward direction. Thus the rebound abrasive fluid 51 splashes back onto the protective sleeve 21 surrounding the extension tool 20. The rest of the cutting assembly 16, particularly the abrasive jet perforating tool 18, is spared.

Figure 6:
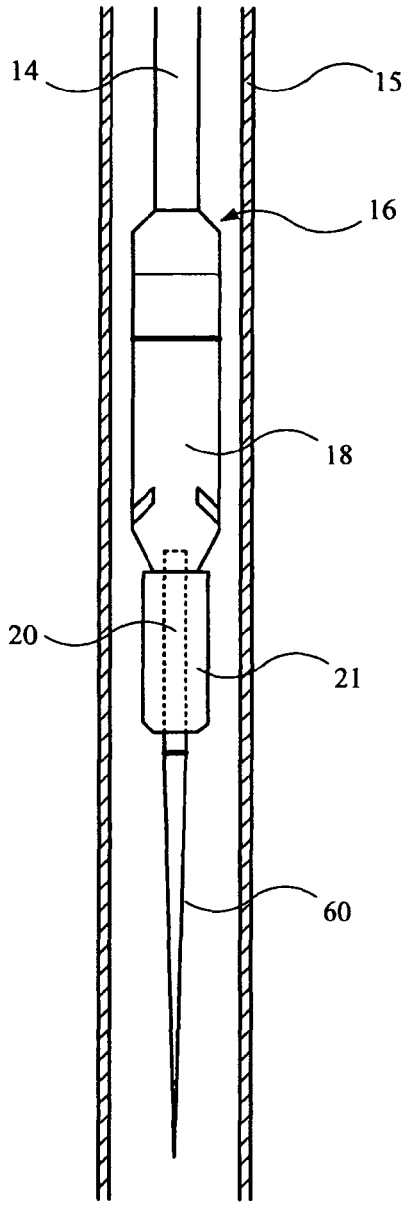
FIG. 6 shows a schematic side view of another embodiment of a cutting assembly of the invention, particularly for narrow size restrictions.

FIG. 6 shows a schematic side view (not necessarily to scale) of another embodiment of a cutting assembly of the invention. In this embodiment, the alternative cutting assembly 16 is configured to fit through tight size restrictions of narrow tubular members 15. The alternative cutting assembly 16 is suspended from tubing 14 inside a tubular member 15. The alternative cutting assembly 16 now further comprises a centering needle 60 mounted at the bottom of the cutting assembly 16. In particular, the centering needle 60 can be connected to the extension tool 20 which carries the protective sleeve 21. The centering needle 60 would allow the cutting assembly 16 to pass through downhole tools that are found in a drill string, such as a drilling jar. Many of these downhole tools have internal parts that are exposed to the inner diameter of the downhole tool. In order to keep the cutting assembly 16, in particular, the abrasive jet perforating tool 18, from snagging on these internal parts, the needle serves as a guide to insure that the abrasive jet perforating tool 18 passes through the downhole tool easily.

Figure 7:
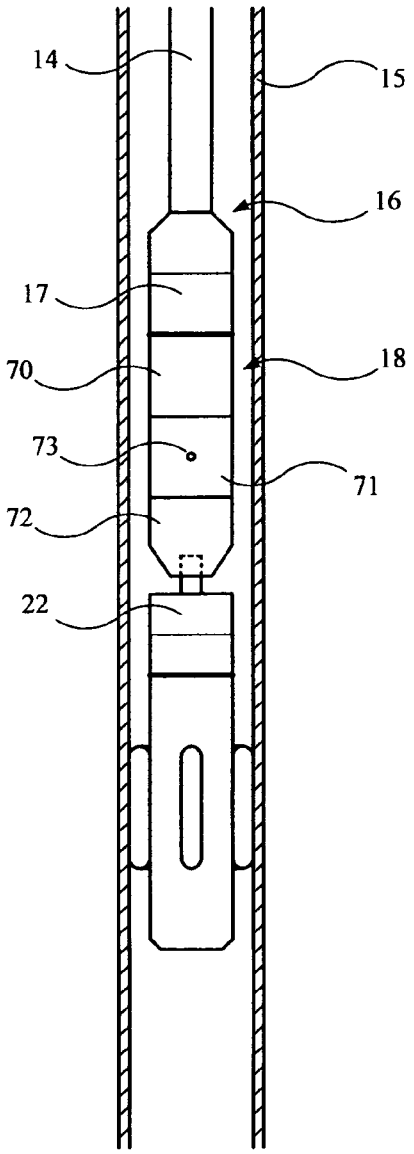
FIG. 7 shows a schematic side view of another embodiment of a cutting assembly of the invention, without a protective sleeve.

FIG. 7 shows a schematic side view (not necessarily to scale) of another embodiment of a cutting assembly of the invention. In this embodiment, the abrasive jet perforating tool 18 comprises three separate sections that are fitted and connected together. The abrasive jet perforating tool 18 comprises a top section 70, a middle section 71, and a bottom section 72. The three sections, when connected together, comprise a conduit, preferably in the form of a generally cylindrically shaped tube 30, similarly to the abrasive perforating tool 18 described with reference to FIG. 3 above. Although the abrasive jet perforating tool 18 is illustrated here with the preferred embodiment of a tube 30 as the body, this cylindrical shape is not necessarily a limitation of the invention. The body could have other appropriate shapes in other alternative embodiments. The middle section 71 is constructed from an abrasion resistant material and the jet orifices 73 may be machined or electric discharge machined directly into the middle section 71. Since the middle section 71 is constructed from a material resistant to abrasive fluid backsplash, the jet orifices 73 are oriented in a direction perpendicular to the longitudinal axis of the abrasive jet perforating tool 18. Thus, no extension tool 20 or protective sleeve 21, as in the cutting assembly 16 illustrated in FIG. 3, is required. The bottom section 72 of the alternate abrasive jet perforating tool 18 may connect directly to the horizontal indexing tool 22 instead.

Figure 8:
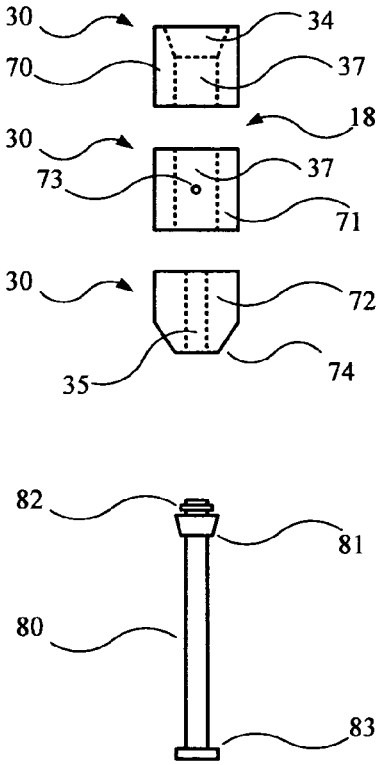
FIG. 8 shows a schematic exploded side view of the abrasive jet perforating tool of FIG. 7 in sections.

FIG. 8 shows a schematic exploded side view (not necessarily to scale) of the abrasive jet perforating tool of FIG. 7 in sections. The top section 70 comprises tube 30 with an upper threaded connection fitting 34, connected to a fluid channel 37. The top section 70 could be constructed of typical oilfield steel alloys. The middle section 71 comprises a tube 30 with a continuation of the fluid channel 37 in the top section 70 and the jet orifices 73. The middle section 71 is constructed of a material that is highly resistant to abrasion. Such materials include, but are not restricted to, tungsten carbide, boron carbide, alumina, cubic zirconium, and steel alloy with a protective coating. The bottom section 72 comprises a tube 30 with a rounded bottom 74 with a lower threaded connection fitting 35, not connected to the fluid channel 37 in the middle section 71. The bottom section 72 may also be constructed of typical oilfield steel alloys, as for the top section 70.

The top section 70, middle section 71, and bottom section 72 are held together by a connecting rod 80 inserted longitudinally through the sections. A flow plate 81 and a fastener 82 are employed at the top of the connecting rod 80 and a fixed end 83 is fixed to the bottom of the connecting rod 80. In addition, the three sections have mating grooves and o-rings (not shown) to seal the fluid channel 37 from the environment outside the abrasive jet perforating tool 18.

The upper threaded connection fitting 34 on the top section 70 is used to connect the abrasive jet perforating tool 18 to other components of the cutting assembly (16 in FIG. 7). In particular, the upper threaded connection fitting 34 on the top section 70 is used to connect the abrasive jet perforating tool 18 to the tubing swivel (17 in FIG. 7). Similarly, the lower threaded connection fitting 35 on the bottom section 72 is used to connect the abrasive jet perforating tool 18 to other components of the cutting assembly (16 in FIG. 7). In particular, the lower threaded connection fitting 35 on the bottom section 72 is used to connect the abrasive jet perforating tool 18 to the horizontal indexing tool (22 in FIG. 7) since the extension tool 20 and protective sleeve 21 (in the embodiment illustrated in FIG. 2) are not required.

A further alternative embodiment involves the shape of the jet orifices in the abrasive jets in the abrasive jet perforating tools described above. The jet orifices in abrasive jet perforating or cutting tools are typically round in cross-section. This round jet orifice results in a jet that produces a round spray pattern that cuts a hole that is generally round itself. In an alternative embodiment, the orifice can be modified to produce an oval or flat, angled spray pattern. Using such an alternative jet orifice that produces an angled spray pattern would be particularly beneficial when cutting tubular members. In use, the wider portion of the angled spray pattern would be oriented with the lateral direction of the desired cut. This orientation would increase the cutting distance of the jet and thus, the horizontal indexing tool that rotates the abrasive jet perforating tool could be designed to move in larger increments. This would cut the tubular members with fewer movements of the horizontal indexing tool and hence in less time.

A variety of different jet quantities, orifice sizes, and placement locations can be used with the improvements listed for the abrasive jet perforating tool of the invention.

Figure 9:
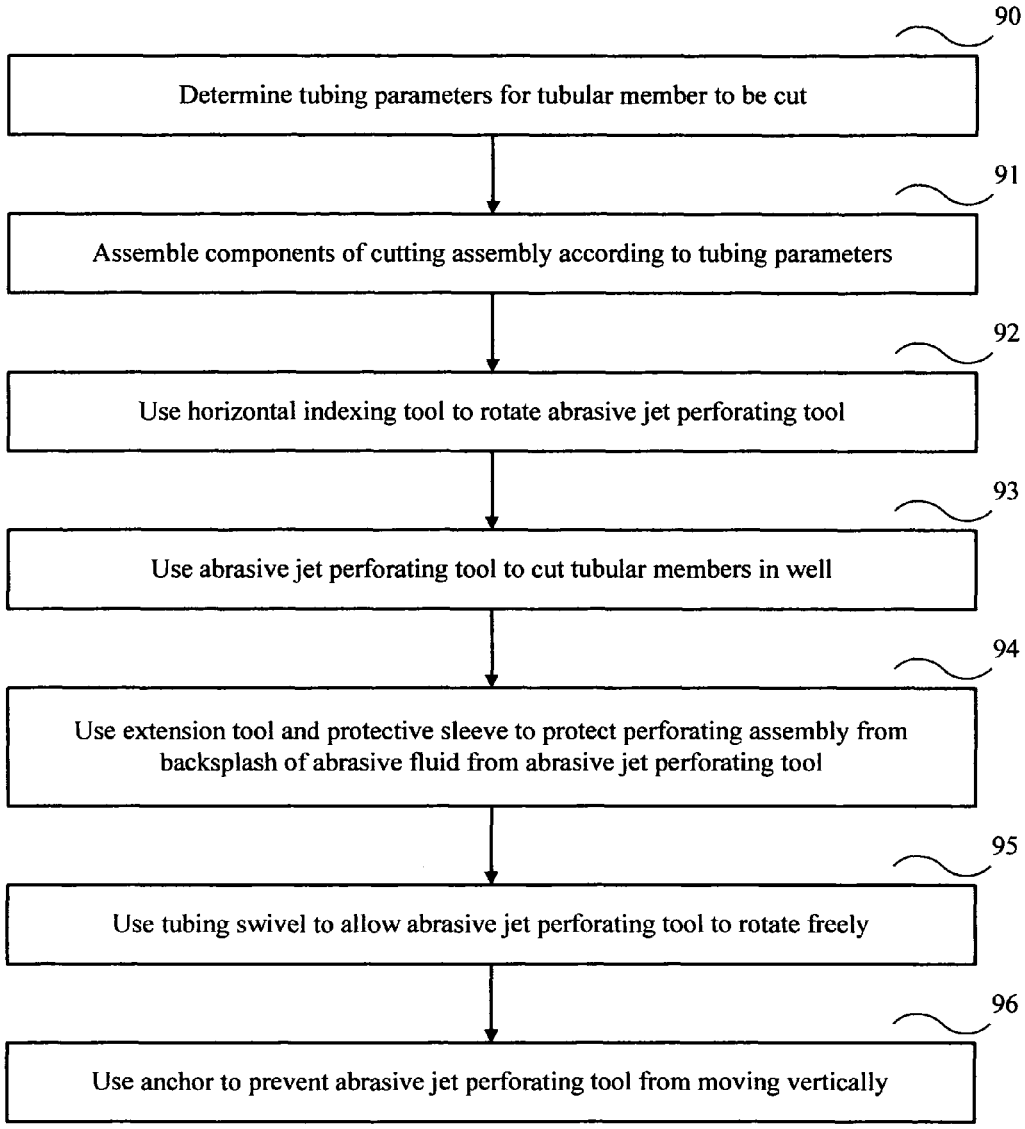
FIG. 9 shows a flowchart illustrating an embodiment of the method of the invention for performing abrasive jet cutting in a wellbore.

In another embodiment, the invention is a method for performing abrasive jet cutting, using the abrasive jet perforating tool of the invention, described above. FIG. 9 is a flowchart illustrating an embodiment of the method of the invention for performing abrasive jet cutting in a wellbore.

At block 90, tubing parameters are determined for a tubular member to be cut. These tubing parameters include, but are not limited to, general well conditions, pump flow rate, the type and thickness of the tubular member to be cut, size restrictions, and the depth at which the cut is to be made.

At block 91, the appropriate components of an apparatus for abrasive jet cutting are assembled according to the tubing parameters determined in block 90. The apparatus for abrasive jet cutting is the apparatus of the present invention, the cutting assembly 16 of FIG. 1. The cutting assembly comprises an abrasive jet perforating tool and a horizontal indexing tool, along with other possible bottomhole tools, all described above in the discussion with reference to FIGS. 2-8. For example, in the embodiment illustrated in FIG. 2, the apparatus comprises a tubing swivel mounted below a tubing string; an abrasive jet perforating tool mounted below the tubing swivel; an extension tool, with protective sleeve, mounted below the abrasive jet perforating tool; a horizontal indexing tool mounted below the extension tool; and an anchor mounted below the horizontal indexing tool.

The particular abrasive jet perforating tool employed can be any of the several embodiments described above with reference to FIGS. 2-8. The assembly of the apparatus for abrasive jet cutting can take place onsite or off-site, wherever is convenient. If the cutting assembly is assembled offsite, then the cutting assembly is shipped to the well site, where the cutting assembly can be easily changed if the well parameters have changed or turn out to be different than originally expected.

At block 92, the horizontal indexing tool is used to rotate the abrasive jet perforating tool.

At block 93, the abrasive jet perforating tool is used to cut tubular members in the well.

At block 94, optionally, the extension tool and protective sleeve, if present, are used to protect the apparatus from backsplash of abrasive fluid from the abrasive jet perforating tool. This protection is employed in the case that the abrasive jet perforating tool further comprises abrasive jets mounted in a direction that is away from perpendicular.

At block 95, optionally, the tubing swivel, if present, is used to allow the abrasive jet perforating tool to rotate freely. This freedom to rotate allows the horizontal indexing tool to rotate the abrasive jet perforating tool without having to rotate the entire tubing string.

At block 96, optionally, the anchor, if present, is used to prevent the abrasive jet perforating tool from moving vertically.

Figure 10:
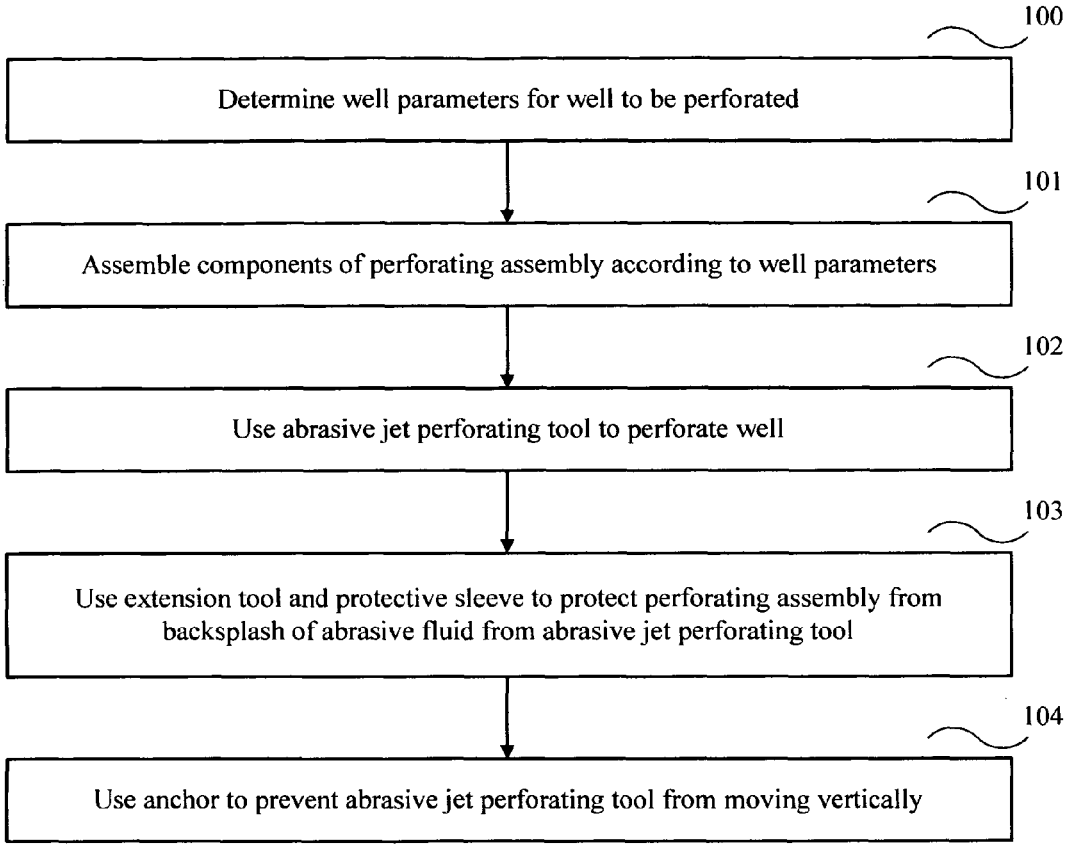
FIG. 10 shows a flowchart illustrating an embodiment of the method of the invention for performing abrasive jet perforating in a wellbore.

In another embodiment, the invention is a method for performing abrasive jet perforating, using the abrasive jet perforating tool of the invention, described above. FIG. 10 is a flowchart illustrating an embodiment of the method of the invention for performing abrasive jet perforating in a wellbore.

At block 100, parameters are determined for a well to be perforated. These well parameters include, but are not limited to, the type and thickness of casing, the type and thickness of cement, the type of reservoir rock to be encountered in the zones to be perforated, and the depth of the zones to be perforated.

At block 101, the appropriate components of an apparatus for abrasive jet perforating are assembled according to the well parameters determined in block 100. The apparatus for abrasive jet perforating is the apparatus of the present invention, as described above with reference to FIGS. 1-8. The apparatus comprises an abrasive jet perforating tool, along with other possible bottomhole tools, all described above in the discussion with reference to FIGS. 2-8. For example, in the embodiment illustrated in FIG. 2, For example, in the embodiment illustrated in FIG. 2, the apparatus comprises a tubing swivel mounted below a tubing string; an abrasive jet perforating tool mounted below the tubing swivel; an extension tool, with protective sleeve, mounted below the abrasive jet perforating tool; a horizontal indexing tool mounted below the extension tool; and an anchor mounted below the horizontal indexing tool.

The particular abrasive jet perforating tool employed can be any of the several embodiments described above with reference to FIGS. 2-8. The assembly of the tool can take place onsite or off-site, wherever is convenient. If the tool is assembled offsite, then the tool is shipped to the well site, where the tool assembly can be easily changed if the well parameters have changed or turn out to be different than originally expected.

At block 102, the abrasive jet perforating tool is used to perforate the well. In an alternative embodiment, the horizontal indexing tool can be employed to rotate the abrasive jet perforating tool, but no so much that the resulting perforations sever tubular members in the well.

At block 103, optionally, the extension tool and protective sleeve, if present, are used to protect the apparatus from backsplash of abrasive fluid from the abrasive jet perforating tool. This protection is employed in the case that the abrasive jet perforating tool further comprises abrasive jets mounted in a direction that is away from perpendicular.

At block 104, optionally, the anchor, if present, is used to prevent the abrasive jet perforating tool from moving vertically.

It should be understood that the preceding is merely a detailed description of specific embodiments of this invention and that numerous changes, modifications, and alternatives to the disclosed embodiments can be made in accordance with the disclosure here without departing from the scope of the invention. The preceding description, therefore, is not meant to limit the scope of the invention. Rather, the scope of the invention is to be determined only by the appended claims and their equivalents.

I claim:

1. An apparatus for performing abrasive jet cutting, comprising:

an abrasive jet perforating tool coupled rotatably to a tubing string in a well bore, wherein the abrasive jet perforating tool comprises:

a generally cylindrically-shaped tube comprising a side, an upper end, and a lower end;

an upper threaded connection fitting in the upper end of the tube;

a plurality of holes drilled into the side of the tool;

access holes positioned in the side of the tool above the plurality of holes;

a fluid channel extending longitudinally from the upper threaded connection fitting to the plurality of holes;

abrasive jets inserted in at least some of the plurality of holes, wherein the abrasive jets are inserted in at least some of the plurality of holes using the access holes; and a lower threaded connection fitting in the lower end of the tube, wherein the lower threaded connection fitting in the lower end of the tube is unconnected to the fluid channel; and a horizontal indexing tool cycled by a vertical movement of the tubing string, coupled connectably to the abrasive jet perforating tool, and used to rotate the abrasive jet perforating tool radially in the wellbore.

2. The apparatus of claim 1, further comprising:

an extension tool, with a protective sleeve, coupled to the abrasive jet perforating tool, wherein the abrasive jets are mounted in a direction that is away from perpendicular to a longitudinal axis of the abrasive jet perforating tool.

3. The apparatus of claim 2, further comprising:

a tubing swivel coupled to the tubing string and the abrasive jet perforating tool; and an anchor coupled to the horizontal indexing tool.

4. The apparatus of claim 3, wherein the extension tool is sized to prevent backsplash from the abrasive jet perforating tool from striking the horizontal indexing tool and the anchor.

5. The apparatus of claim 4, wherein the protective sleeve is positioned to deflect backsplash from the abrasive jet perforating tool.

6. The apparatus of claim 5, wherein the protective sleeve is composed of a material selected from the group consisting of tungsten carbide, boron carbide, alumina, cubic zirconium, or steel alloy with a protective coating.

7. The apparatus of claim 3, wherein the anchor prevents the abrasive jet perforating tool from moving vertically.

8. The apparatus of claim 2, further comprising a centering needle mounted below the extension tool.

9. The apparatus of claim 1, wherein the plurality of holes are tapped into the side of the tool, wherein the abrasive jets are inserted in at least some of the plurality of tapped holes using the access holes.

10. The apparatus of claim 9, wherein the abrasive jets comprise threaded abrasive jets.

11. The apparatus of claim 10, wherein the threaded holes are positioned in a lateral plane perpendicular to a longitudinal axis of the tube and oriented in a direction that is below perpendicular to the longitudinal axis of the tube.

12. The apparatus of claim 10, wherein the abrasive jets further comprise jetted orifices.

13. The apparatus of claim 1, wherein the abrasive jet perforating tool comprises:

an upper section comprising the upper threaded connection fitting and at least a portion of the longitudinal fluid channel, wherein the upper end of the generally cylindrically-shaped tube comprises the upper section;

a middle section comprising another portion of the longitudinal fluid channel that lines up with the fluid channel in the upper section, wherein the plurality of holes are tapped and threaded into the middle section, and wherein at least a portion of the abrasive jets are threaded abrasive jets, wherein the side of the generally cylindrically-shaped tube comprises the middle section;

a lower section comprising the lower threaded connection fitting, wherein the lower end of the generally cylindrically-shaped tube comprises the lower section; and a joining assembly extending longitudinally through the upper, middle, and lower sections, connecting the sections.

14. The apparatus of claim 13, wherein the threaded holes are positioned in a lateral plane perpendicular to a longitudinal axis of the middle section and oriented in a direction that is perpendicular to the longitudinal axis of the middle section.

15. The apparatus of claim 1, wherein the horizontal indexing tool rotates the abrasive jet perforating tool a predetermined angle each time the horizontal indexing tool is cycled by a vertical stroke of the tubing string.

16. A method for performing abrasive jet cutting, comprising:

determining well parameters for a well;

assembling, according to the well parameters, an apparatus for performing abrasive jet cutting in a wellbore, the apparatus comprising:

an abrasive jet perforating tool coupled rotatably to a tubing string, wherein the abrasive jet perforating tool comprises:

a generally cylindrically-shaped tube comprising a side, an upper end, and a lower end;

an upper threaded connection fitting in the upper end of the tube;

a plurality of holes drilled into the side of the tool;

access holes positioned in the side of the tool above the plurality of holes;

a fluid channel extending longitudinally from the upper threaded connection fitting to the plurality of holes;

abrasive jets inserted in at least some of the plurality of holes, wherein the abrasive jets are inserted in at least some of the plurality of holes using the access holes; and a lower threaded connection fitting in the lower end of the tube, wherein the lower threaded connection fitting in the lower end of the tube is unconnected to the fluid channel; and a horizontal indexing tool cycled by a vertical movement of the tubing string, coupled connectably to the abrasive jet perforating tool, and used to rotate the abrasive jet perforating tool radially in the well bore; and using the abrasive jet perforating tool to perforate tubular members in the well.

17. The method of claim 16, further comprising:

using the abrasive jet perforating tool to cut the tubular members in the well.

18. The method of claim 16, further comprising: assembling the apparatus for performing abrasive jet cutting to further comprise:

an extension tool, with a protective sleeve, coupled to the abrasive jet perforating tool, wherein the abrasive jets are mounted in a direction that is away from perpendicular to a longitudinal axis of the abrasive jet perforating tool; and using the extension tool and protective sleeve to protect the apparatus from backsplash of abrasive fluid from the abrasive jet perforating tool.

19. The method of claim 18, further comprising:

using the abrasive jet perforating tool to cut the tubular members in the well.

20. The method of claim 19, further comprising: assembling the apparatus for performing abrasive jet cutting to further comprise:

a tubing swivel coupled to the tubing string; and an anchor coupled to the horizontal indexing tool; and using the tubing swivel to allow the abrasive jet perforating tool to rotate freely; and using the anchor to prevent the abrasive jet perforating tool from moving vertically.

21. The method of claim 16, wherein the plurality of holes are tapped into the side of the tool, wherein the abrasive jets are inserted in at least some of the plurality of tapped holes using the access holes.

22. The method of claim 16, wherein the abrasive jet perforating tool comprises:

an upper section comprising the upper threaded connection fitting and at least a portion of the longitudinal fluid channel, wherein the upper end of the generally cylindrically-shaped tube comprises the upper section;

a middle section comprising another portion of the longitudinal fluid channel that lines up with the fluid channel in the upper section, wherein the plurality of holes are tapped and threaded into the middle section, wherein at least a portion of the abrasive jets are threaded abrasive jets, and wherein the side of the generally cylindrically-shaped tube comprises the middle section;

a lower section comprising the lower threaded connection fitting, wherein the lower end of the generally cylindrically-shaped tube comprises the lower section; and a joining assembly extending longitudinally through the upper, middle, and lower sections, connecting the sections.

* * * * *